United States Patent [19]

Lillis et al.

[11] Patent Number: 4,746,248

[45] Date of Patent: May 24, 1988

[54] ANCHOR BOLT ASSEMBLY

[75] Inventors: Jack W. Lillis, Berryville, Va.; Ronald D. Unger, Martinsburg, W. Va.

[73] Assignee: E. I. Du Pont de Nemours and Company, Wilmington, Del.

[21] Appl. No.: 16,395

[22] Filed: Feb. 19, 1987

[51] Int. Cl.[4] ..... E21D 20/02

[52] U.S. Cl. ..... 405/260; 405/259; 411/534; 252/22

[58] Field of Search ..... 405/259–261; 411/534, 531, 538; 252/9, 22

[56] References Cited

U.S. PATENT DOCUMENTS

| | | | |
|---|---|---|---|
| 3,244,625 | 4/1966 | Silwones | 411/534 X |
| 3,375,193 | 3/1968 | Ruzza et al. | 252/22 X |
| 3,377,278 | 4/1968 | Ruzza | 252/22 X |
| 3,504,498 | 4/1970 | Triplett | 405/259 |
| 3,634,129 | 1/1972 | Benz | 117/119.6 |
| 3,914,178 | 10/1975 | Fineran et al. | 252/12 |
| 3,962,103 | 6/1976 | Johnston et al. | 252/22 |
| 4,074,011 | 2/1978 | Teramoe et al. | 428/422 |
| 4,097,257 | 6/1978 | Davey | 252/22 X |
| 4,179,529 | 12/1979 | Vetter | 252/9 X |
| 4,183,699 | 1/1980 | Donan, Jr. et al. | 405/259 |
| 4,206,060 | 6/1980 | Yamamoto et al. | 252/22 |
| 4,354,948 | 10/1982 | Schoch et al. | 252/22 |
| 4,362,449 | 12/1982 | Hlinsky | 411/534 X |
| 4,371,293 | 2/1983 | Wilcox et al. | 405/259 |
| 4,518,292 | 5/1985 | Calandra, Jr. | 411/82 |
| 4,564,315 | 1/1986 | Rozanc | 405/261 |
| 4,619,559 | 10/1986 | Norris | 405/259 |

*Primary Examiner*—Dennis L. Taylor
*Attorney, Agent, or Firm*—James T. Corle

[57] ABSTRACT

An achor bolt assembly for securing a bolt in a bore hole is provided with supporting members for applying pressure against an area surrounding the mouth of the bore hole wherein contacting surfaces of the supporting members are provided with a coating of a latent lubricating material which becomes an active lubricant in response to heat generated as the bolt is rotated and tensioned in the bore hole.

7 Claims, 2 Drawing Sheets

ANCHOR BOLT ASSEMBLY

FIELD OF THE INVENTION

This invention relates to an anchor bolt assembly. More particularly, the invention relates to a delayed tensioning bolt assembly useful in bore holes containing a settable bonding material. Such assemblies are useful in anchoring heavy machinery, in construction applications and mine roof supports.

DESCRIPTION OF RELATED ART

It is known in the art of mine roof support and related anchoring systems to tension bolts by the use of various systems in combination with a settable bonding material. Typically a mine roof bolt is comprised of an elongated bolt, an anchoring device such as a nut, a support means such as a roof plate and a hardened flat washer which is placed between the bolt head and the roof plate. The use of the hardened washer is addressed in ASTM Standard F432-83 and 30 CFR Part 75. One type of roof plate is described in U.S. Pat. No. 4,371,293. The popular bonding materials are provided in compartmented packages in which a resin and a catalyst for the resin are separated. Such a system is disclosed in U.S. Pat. No. 4,280,943. Mixing of the resin and catalyst and tensioning of the bolts must take place within a very short period of time. The bolt assembly is inserted into the bore hole and rotated at high speeds to effect mixing. In some systems which utilize mechanical expansion elements and settable bonding material, tensioning starts almost immediately after rotation of the bolt begins. A significant amount of tensioning takes place in such a system while the resin is in a softened state. In other systems such as those described in U.S. Pat. No. 4,564,315; U.S. Pat. No. 4,518,292; and U.S. patent application Ser. No. 895,672, filed Aug. 11, 1986; and a continuation thereof, Ser. No. 948,132, filed Dec. 31, 1986, tensioning is delayed until the resin begins to harden.

In tensioning of a bolt, a very significant portion of the energy used to tension can be dissipated at the bolt head because of friction unless a means is provided to reduce the effects of friction. This energy loss results in unnecessary heating at the bolt head, a reduction in the level of tensioning that could otherwise be achieved, and variability in tensioning from bolt to bolt.

SUMMARY OF THE INVENTION

In accordance with this invention, there is provided an anchor bolt assembly that includes support means engaged by the anchor bolt which functions as a thrust bearing during tensioning of the bolt. An elongated bolt is provided with mixing and tensioning means. At the time of assembly or prior to insertion of the assembly into a bore hole containing a settable bonding material, support means for applying force against an area surrounding the mouth of the bore hole is positioned adjacent to the head of the bolt. The support means may include a combination of members having abutting planar surfaces, for example two washers which rest on the shoulder on the bolt head. The configuration of the members should be selected to prevent the bolt head from being pulled into the bore hole as the bolt is tensioned and also to spread the pressure generated by bolt tensioning over a large area. At least two contiguous surfaces of the members are coated with a latent lubricating material. The coating may vary in thickness from about 0.1 mm to about 2.0 mm depending on the material used. The thickness of the coating is not critical. Preferably the two contiguous surfaces are releaseably adhered to each other by the lubricating material.

Prior to inserting the bolt assembly into the bore hole a settable bonding material packaged in a breakable cartridge is inserted in the bore hole. The cartridge is advanced to the blind end of the bore hole upon insertion of the bolt assembly. Rotation of the bolt assembly effects mixing of the settable bonding material. As the bolt assembly rotates, heat develops within the support means due to friction between the bolt head and/or assembly and an adjacent surface. As the temperature rises, the latent lubricating material is activated, melting and functioning as a lubricant. The support means now acts as a lubricated thrust bearing as rotation of the bolt is continued and as the bolt is tensioned.

A preferred latent lubricating material is a hot-melt adhesive composition, an example is HM 908, sold by the H. B. Fuller Company, which melts at a temperature of about 150° C. Other latent lubricants that adhere well to the surface of the supporting members and are dry to the touch under normal storage and shipping conditions may be used. Such materials include commercially available products such as H. B. Fuller Co. HM-2047, United Resin Products 80-7801 and 80-7923 hot melt adhesives as well as similar products which function as latent lubricants. The particular material selected will depend on such factors as the temperatures which develop during the mixing and tensioning steps, melting temperature of the latent lubricating material and the shipping and storage environment for the anchor bolt assembly. The latent lubricating material also functions as a protective coating preventing corrosion and other damage to the supporting members and assists in controlling contamination between the surfaces of the supporting members. In some applications the material may be applied to other surfaces of the bolt assembly such as the bolt threads and shaft. The material functions as a lubricant on those surfaces when the temperature rises due to friction.

DETAILED DESCRIPTION

Figure 1:
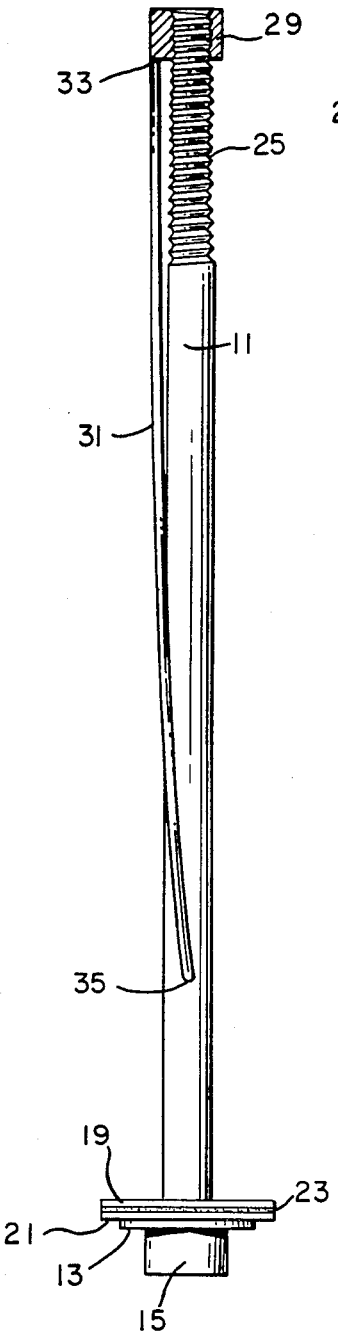
FIG. 1 is a side elevation view partially in section of an anchor bolt assembly showing the supporting means resting on the shoulder of the bolt head.

The anchor bolt assembly of the present invention includes an elongated bolt 11 having a flange 13 and head 15 on one end. Positioned on bolt 11 adjacent flange 13 is the support means consisting of washers 19 and 21. Washers 19 and 21 have a coating of a latent lubricating material 23 on their abutting surfaces. It is not essential that a layer of latent lubricating material 23 be present on all planar surfaces of the supporting means. It is essential, however, that a layer be present between washers 19 and 21. The opposite end of the bolt has a threaded portion 25. The threaded portion 25 is adapted to receive nut 29. As shown in FIG. 1, an elongated rod 31 is attached to nut 29 at point 33 and is loosely spiraled to a point of attachment 35 on bolt 11.

Figure 2:
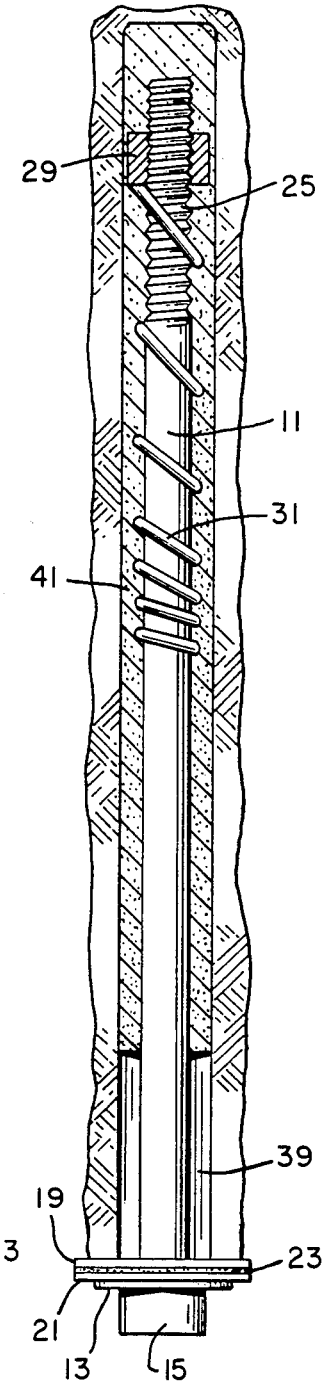
FIG. 2 is a view similar to FIG. 1 illustrating the bolt tensioned in rock strata with the supporting means in abutting relationship with the area surrounding the mouth of the bore hole.

FIG. 2 illustrates the anchor bolt assembly positioned in bore hole 39. The assembly has been inserted with threaded end portion 25 first entering bore hole 39 and piercing a frangible package containing a settable bonding material 41 such as that disclosed in U.S. Pat. No. 4,280,943. When fully inserted, the assembly is rotated rapidly, e.g., at from about 300 to 600 revolutions per minute for about 5 to 10 seconds. During that period heat develops within the support means due to friction and coating 23 begins to melt. After pausing for a few seconds, e.g., 5 to 25 seconds, rotation of bolt 11 is resumed. The drag of the setting bonding material 41 causes rod 31 to loosely coil about bolt 11. As the cure of bonding material 41 proceeds, drag on rod 31 increases breaking it away from its point of attachment 35 and coiling rod 31 about bolt 11. As the heat within the support means builds up, the latent lubricating material 23 melts and functions as a lubricant between washers 19 and 21. The support means functions as a lubricated thrust bearing until such time as the lubricant is forced from between the two washers by the tensioning of bolt 11 as nut 29 is pulled down into the setting bonding material 41 and is finally frozen therein. The support means consisting of washers 19 and 21 resting on flange 13 of bolt 11 are pressed together providing a unitary structure which uniformly spreads the pressure generated by bolt tensioning over a large area.

Figure 3:
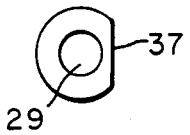
FIG. 3 is a top plan view of a nut for the bolt showing a cutaway portion of the shoulder of the nut.

As shown in FIG. 3, nut 29 has a cutaway shoulder. The shape and diameter of nut 29 is selected to permit entry of the nut into a bore hole and to permit passage of a settable bonding material between the nut and the walls of the bore hole. Further in this regard, if the support means is to be positioned on bolt 11 after threading nut 29 onto bolt 11 and attaching elongated rod 31 to nut 29 and bolt 11, washers 19 and 21 must have an opening diameter large enough to pass over nut 29 and rod 31.

Figure 4:
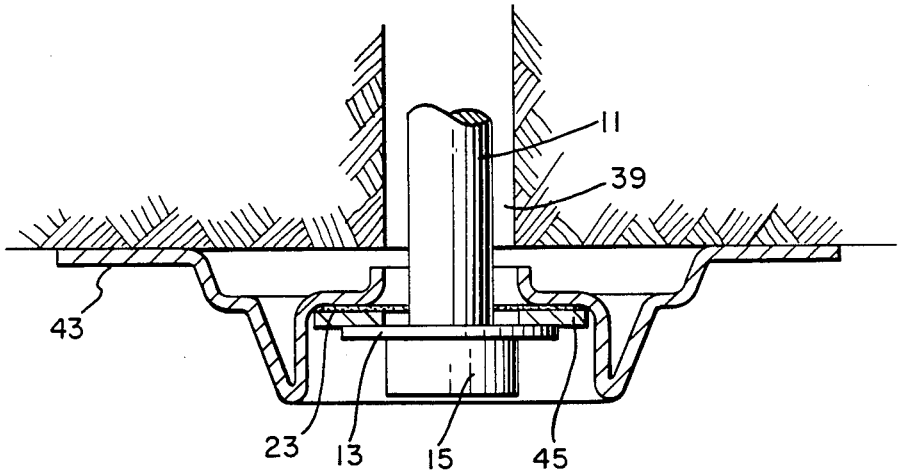
FIG. 4 is a fragmentary side elevation view partially in section of an anchor bolt assembly showing the head of the bolt and the supporting means including a roof plate and a washer resting on the shoulder of the bolt head.
Figure 5:
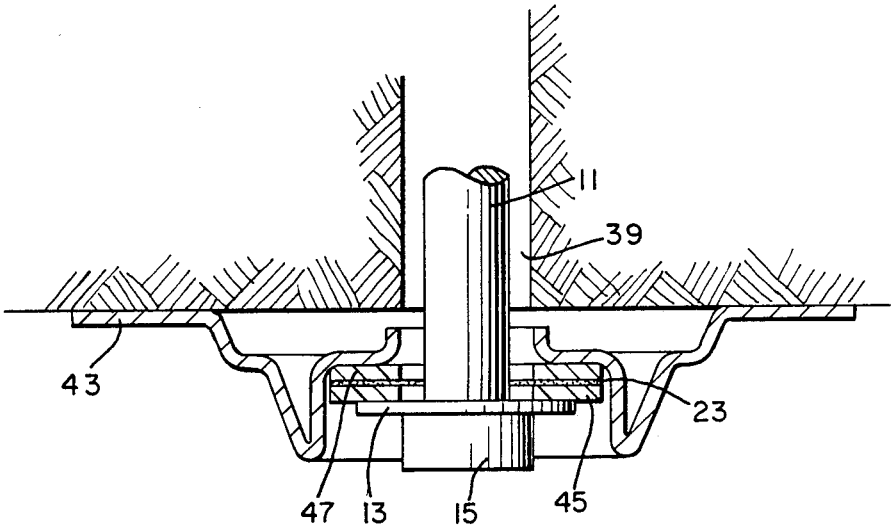
FIG. 5 is a view similar to FIG. 4 showing supporting means including a roof plate and two washers adjacent the bolt head. This is a preferred embodiment.

FIGS. 4 and 5 show alternative embodiments of support means. In FIG. 4 roof plate 43 and washer 45 are supported by flange 13 of bolt head 15. Washer 45 is provided with a latent lubricating material coating 23. If desired, roof plate 43 may be coated on the surface abutting washer 45.

In FIG. 5 an additional washer 47 is positioned on bolt 11 adjacent to flange 13. The washers are releasably adhered to each other by a coating of latent lubricating material 23 on adjacent surfaces of the washers.

Comparative tests were made in the laboratory to measure frictional loss using the support means of this invention similar to that shown in FIG. 5. For the tests a standard flat washer as described in ASTM Standard F432-83 and two standard zinc-plated steel washers were used. All washers had an outside diameter of 5 centimeters and an inside diameter of 1.9 centimeters. The latent lubricating material used was H. B. Fuller Co., HM-908 hot melt adhesive. The adhesive was heated to about 175° C. and the washers of the supporting means were heated to about 82° C. prior to coating. Only the contiguous surfaces of the washers were coated, and the washers were then pressed together for adherence to each other. In carrying out the tests, the washers were placed onto an elongated bolt of 1.43 centimeter diameter and 1.22 meters long. For each test, a mine roof plate was placed on the bolt on top of the washers and then a round steel backing plate of 15 centimeter diameter and 1.25 centimeter thickness with a 2.5 centimeter hole in the middle was placed on top of the mine roof plate. The end of the bolt opposite the head was inserted into a steel test bore of 2.54 centimeter diameter. The entire assembly was then placed in a machine having a vice to hold the test bore vertical and rigid, a hydraulic motor driving a chuck to engage the bolt head and rotate it, and a thrust mechanism for pushing the bolt into the test bore. The thrust is variable from 0 to 34,700 newtons, RPM of the motor is variable from 0 to 500, and the torque developed by the motor is variable from 0 to 540 newton-meters. The parameters are measured by sensors and recorded on a strip chart recorder. Tensioning of the bolt was simulated by applying a thrust force against the head of the bolt which in turn transmitted the force to the washers, mine roof plate, backing plate, and test bore. The bolt was rotated at 450 RPM, and the torque required for rotation was measured and compared for three different values of simulated tension. (The torque required for rotation represents an energy loss which is experienced when bolts are actually installed and tensioned). In the first test conducted using a single standard hardened washer and roof plate of the type described in ASTM F432-83 (no latent lubricating material was used), the energy dissipated at 13,300 newtons bolt tension was 86 newton-meters; at 17,800 newtons it was 140 newton-meters, and at 31,100 newtons it was 300 newton-meters. For a given bolt tension the loss increased with time as the bolt assembly was rotated and the washer heated. The test was repeated substituting two standard zinc-plated steel washers for the single hardened washer. Losses recorded were 76 newton-meters at 13,300 newtons of bolt tension, 140 newton-meters at 17,800 newtons of tension, and 300 newton-meters at 31,100 newtons of tension. Again the losses increased with time as the washers heated. The test was again repeated substituting the support system of this invention shown in FIG. 5 which included the latent lubricating material. The energy loss remained constant at 16 newton-meters up to 17,800 newtons of bolt tension and was no greater than 32 newton-meters at 31,100 newtons of tension.

Test installations of the anchor bolt assembly were made in a mine using the support means of this invention shown in FIG. 5. The anchor bolt assembly was the assembly shown in FIG. 1. A rubber compression pad was placed on the bolt adjacent to the roof plate to measure bolt tension. The latent lubricating material was H. B. Fuller Co.'s HM-908 hot-melt adhesive deposited on zinc-plated steel washers with outside diameter of 5 centimeters, inside diameter of 1.9 centimeters, and thickness of 4 millimeters. All bolts had a length of 1.22 meters and a diameter of 1.43 centimeters. The elongated rod attached to the bolt assembly had a length of 30.5 centimeters and a diameter of 3.2 millimeters. One end of the rod was welded to the nut, and the other end was welded to the bolt. The welds were of such strength as to permit selective detachment of the rod from the bolt. The settable bonding material was Du Pont Fasloc® rock bolt bonding material contained in a compartmented package containing resin and a catalyst. The package was a nominal 2.3 centimeters in diameter and 40 centimeters long. Mixing time for the resin and catalyst was typically 5–8 seconds. Gel time was typically 15–20 seconds. Bore holes having a diameter of 2.54 centimeters were drilled to a depth of 1.22 meters in the mine roof. In each test, a package of bonding material was inserted into the bore hole. The bolt assembly was inserted into the bore hole piercing the package containing the bonding material. Mixing of the resin and catalyst was effected by rotating the bolt assembly at about 560 RPM for 5–8 seconds. Mixing was then stopped for 15–20 seconds to allow the bonding materials to gel. The bolt was again rotated until the machine stalled out. A roof bolt compression pad and a compression pad gauge manufactured by the Goodyear Rubber Co., St. Mary's, Ohio, were used to measure bolt tension. Tension was determined by measuring the increase in circumference of the Goodyear compression pad using the gauge which is calibrated to indicate bolt tension. The machine used to drill the bore holes and insert and tension the bolts was a standard mine roof bolting machine capable of drilling holes and installing bolts vertically. The machine was set to deliver a maximum torque for tensioning the bolts of 340 newton-meters. Use of the support means of this invention doubled the bolt tensions as compared to tensions previously achieved using a single standard hardened washer and roof plate. Of the five bolts tested, the tensions were 45,400; 52,000; 56,000; 51,600; and 56,900 newtons.

What is claimed is:

1. A bolt assembly for securing a bolt in a bore hole having a settable bonding material therein comprising in combination (a) an elongated bolt, (b) means for mixing at least a portion of said bonding material in said bore hole upon rotation of said bolt, (c) support means engaged by said bolt for applying force against an area surrounding the mouth of said bore hole comprising first and second support members positioned on said bolt, said first member having a planar surface adjacent to said area and an opposing surface releaseably adhered to a contiguous surface of said second member by a latent lubricating material, said lubricating material becoming an active lubricant in response to heat generated during rotation of said bolt, and (d) means for tensioning said bolt in said bore hole as said bonding material sets to a hardened state.

2. A bolt assembly for securing a bolt in a bore hole having a settable bonding material therein comprising in combination (a) an elongated bolt, (b) means for mixing at least a portion of said bonding material in said hole upon rotation of said bolt, (c) a support plate on said bolt in abutting relationship with an area surrounding said bore hole, (d) a second supporting member on said bolt having a planar surface adjacent to said support plate, said second supporting member having a latent lubricating material at least on the planar surface, said lubricating material becoming an active lubricant in response to heat generated during rotation of said bolt, and (e) means for tensioning said bolt in said bore hole as said bonding material sets to a hardened state.

3. The bolt assembly of claim 2 wherein said latent lubricating material is a hot-melt adhesive.

4. A bolt assembly for securing a bolt in a bore hole having a settable bonding material therein comprising in combination (a) an elongated bolt, (b) means for mixing said bonding material in said hole upon rotation of said bolt, (c) a support plate on said bolt in abutting relationship with an area surrounding said bore hole, (d) first and second support members positioned on said bolt, said first member having a planar surface adjacent to said support plate and an opposing surface releaseably adhered to a contiguous surface of said second member by a latent lubricating material, said lubricating material becoming an active lubricant in response to heat generated during rotation of said bolt, and (e) means for tensioning said bolt in said bore hold as said bonding material sets to a hardened state.

5. The bolt assembly of claim 4 wherein said first and second support members are adhered to each other with a hot-melt adhesive.

6. The bolt assembly of claim 4 wherein said bolt has a threaded portion on one end, said threaded portion having a coating of latent lubricating material thereon.

7. The bolt assembly of claim 6 wherein a section of the bolt adjacent to the threaded portion has a coating of latent lubricating material thereon.

* * * * *